US005544629A

United States Patent [19]

Ohata et al.

[11] Patent Number: 5,544,629

[45] Date of Patent: Aug. 13, 1996

[54] INTAKE SYSTEM IN V-SHAPED ENGINE

[75] Inventors: Satoru Ohata; Tomohiro Iiboshi, both of Wako, Japan

[73] Assignee: Honda Giken Kogyo Kabushiki Kaisha, Tokyo, Japan

[21] Appl. No.: 496,909

[22] Filed: Jun. 29, 1995

[30] Foreign Application Priority Data

Jun. 29, 1994 [JP] Japan ..... 6-148149

[51] Int. Cl.[6] ..... F02M 35/10

[52] U.S. Cl. ..... 123/184.36; 123/184.61

[58] Field of Search ..... 123/184.34, 184.35, 123/184.36, 184.61

[56] References Cited

U.S. PATENT DOCUMENTS

| | | | |
|---|---|---|---|
| 4,741,294 | 5/1988 | Yasuda et al. | 123/184.36 |
| 4,919,087 | 4/1990 | Ogami et al. | 123/184.36 |
| 5,003,932 | 4/1991 | Duncan | 123/184.34 |
| 5,016,579 | 5/1991 | Suzuki et al. | 123/184.35 |

FOREIGN PATENT DOCUMENTS 62-159725 7/1987 Japan .

*Primary Examiner*—Marguerite McMahon
*Attorney, Agent, or Firm*—Nikaido Marmelstein Murray & Oram LLP

[57] ABSTRACT

An intake system for use in a V-shaped engine includes an intake manifold which is disposed in a valley defined between a pair of cylinders, disposed in a substantially V-shaped arrangement, and which includes a pair of intake pipe assemblies having a plurality of intake pipes coupled at their one end to the cylinders, respectively, and a surge tank which is flange-coupled commonly to the other end of the intake pipe assemblies. In the intake system, each of the intake pipe assemblies and the surge tank is formed from a synthetic resin, and a spacer made of a metal, and having clamping bolts integrally provided thereon, is interposed between each of the flanges of the intake pipe assemblies and a flange of the surge tank. Each of the flanges of the intake pipe assemblies and the flange of the surge tank are coupled to each other by the clamping bolts inserted through the flanges of the intake pipe assemblies. Thus, it is possible to provide a reduction in weight of each of the intake pipe assemblies and the surge tank and moreover to moderate the concentration of stress and assure sealability.

4 Claims, 8 Drawing Sheets

INTAKE SYSTEM IN V-SHAPED ENGINE

BACKGROUND OF THE INVENTION

The present invention relates to an intake system for use in a V-shaped engine.

A conventional intake system for use in a V-shaped engine is disclosed, for example, in Japanese Patent Application Laid-open No. 159725/87.

In the conventional systems, both the intake pipe assemblies and the surge tank are formed from a metal such as a cast iron or an aluminum alloy. This is one factor which increases the weight of the engine. Therefore, it was conceived that the intake pipe assemblies and the surge tank would be formed from a synthetic resin, thereby reducing the weight of the engine. However, the problem arises that if the intake pipe assemblies and the surge tank are merely made of synthetic resin, stress is concentrated on the flange-coupled portions of the intake pipe assemblies and the surge tank, as a result of vibration and thermal elongation from the cylinder head sides. This results in the difficulty of assuring the sealability between the intake pipe assemblies and the surge tank. Thus, when the flanges of the intake pipe assemblies and the surge tank made of the synthetic resin are coupled directly to each other, it is difficult to maintain enough coupling force to assure the sealability against the vibration and the thermal influence from the cylinder head sides.

SUMMARY OF THE INVENTION

Accordingly, it is an object of the present invention to provide an intake system in an V-shaped engine, in which the intake pipe assemblies and the surge tank are formed from a synthetic resin to reduce the weight of the engine and moreover, the concentration of stress is moderated, and the sealability is improved.

To achieve the above object, according to a first aspect and feature of the present invention, there is provided an intake system in a V-shaped engine, comprising: an intake manifold which is disposed in a valley defined between a pair of cylinder heads, disposed in a substantially V-shaped arrangement, and the intake manifold includes a pair of intake pipe assemblies having a plurality of intake pipes coupled at on end, respectively to the cylinders heads, respectively, and a surge tank which is flange-coupled commonly to the intake pipe assemblies, wherein each of the intake pipe assemblies and the surge tank is formed from a synthetic resin, and a spacer made of a metal, and having clamping bolts integrally provided thereon, is interposed between flanges provided at both the intake pipe assemblies and another flange provided at the surge tank, each of the flanges of the intake pipe assemblies and the flange of the surge tank being coupled to each other by the clamping bolts inserted through both the flanges.

With this first feature of the present invention, it is possible to enhance the rigidity of the flange-coupled portions so as to moderate the concentration of stress and also to enhance the sealability.

According to a second aspect and feature of the present invention, in addition to the first feature, the spacer has an additional intake gas passage defined therein.

With this second feature of the present invention, it is unnecessary to separately provide a pipe line for introducing an additional intake gas such as an EGR gas, a blow-dry gas and secondary air, thereby enabling a reduction in the number of parts and a reduction in the number of assembling steps.

According to a third aspect and feature of the present invention, in addition to the first feature, the spacer has a fuel passage defined therein and is connected to a fuel injection valve.

With this third feature of the present invention, it is unnecessary to separately provide a pipe line for introducing fuel to the fuel injection valve, thereby enabling a reduction in the number of parts and a reduction is the number of assembling steps.

According to a fourth aspect and feature of the present invention, in addition to the first feature, the spacer has gaskets integrally provided on opposite surfaces thereof for sealing each of the flanges, the flanges of the intake pipe assemblies and the flange of the surge tank, from each other.

With the fourth feature of the present invention, it is unnecessary to separately prepare gaskets separately from the spacers, thereby enabling a reduction in the number of parts and a reduction is the number of assembling steps.

BRIEF DESCRIPTION OF THE DRAWINGS

The above and other objects, features and advantages of the present invention will become apparent from the following description when considered in conjunction with the accompanying drawings, wherein.

DESCRIPTION OF THE PREFERRED EMBODIMENTS

The present invention will now be described by way of the preferred embodiments with reference to the accompanying drawings. In referring to elements that are similar, generally these elements disposed on different sides of the engine, the subscript 1 and 2 have been used.

Figure 1:
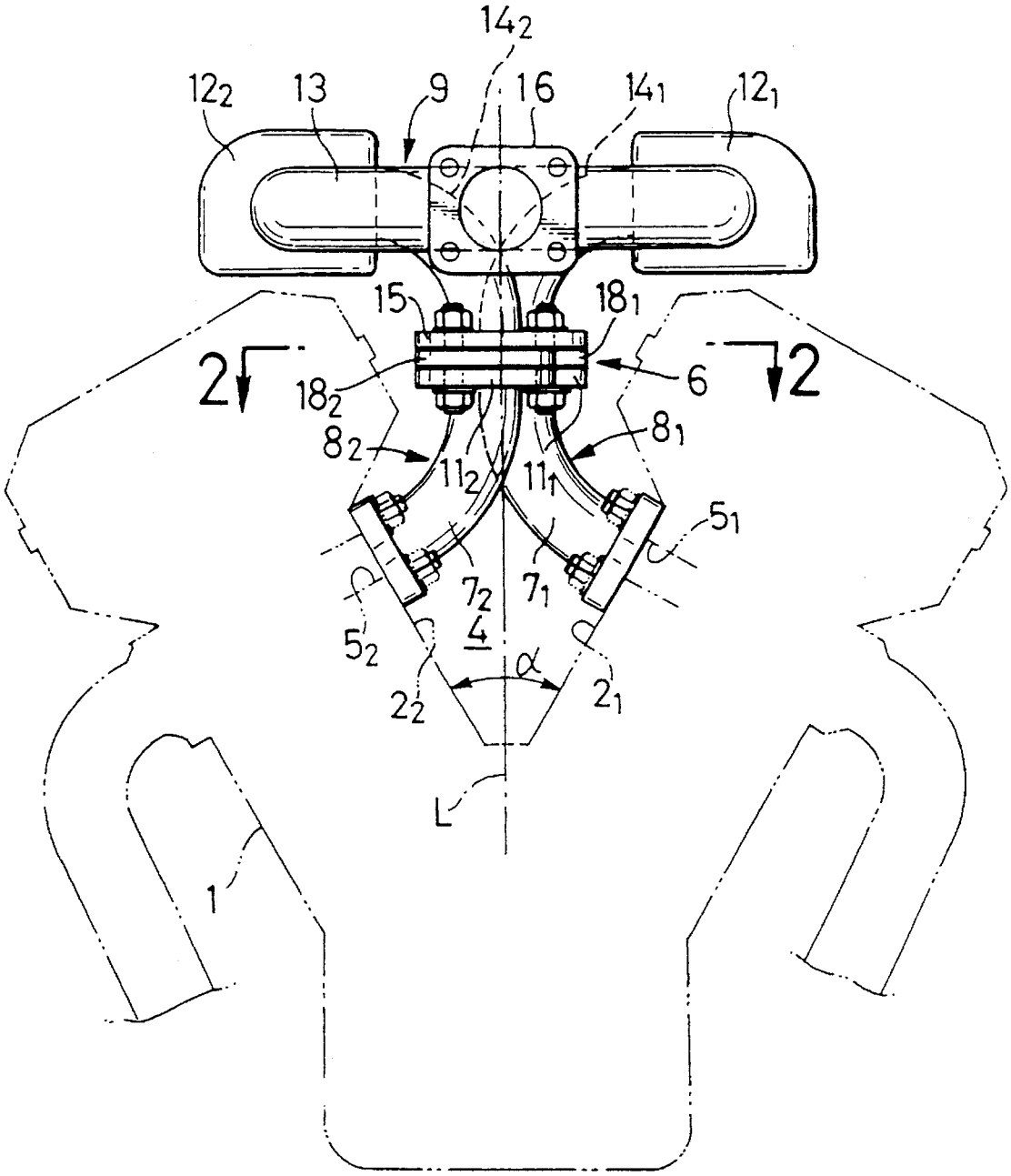
FIG. 1 is a side view of an intake manifold in an intake system according to a first embodiment of the present invention.

Referring first to FIG. 1, for example, in a 6-cylinder engine, a first cylinder head $\mathbf{2}_1$, corresponding to three cylinders, and a second cylinder head $\mathbf{2}_2$, corresponding to the remaining three cylinders, are coupled to each other to form a substantially V-shape at a bank angle $\alpha$ on an upper surface of a cylinder block 1. An intake manifold 6 is disposed in a valley 4 defined between the cylinder heads $\mathbf{2}_1$ and $\mathbf{2}_2$, so that they are connected to three intake ports $\mathbf{5}_1$ and three intake ports 52 provided respectively in the sides of the cylinder heads $\mathbf{2}_1$ and $\mathbf{2}_2$ which are opposed to each other.

Figure 2:
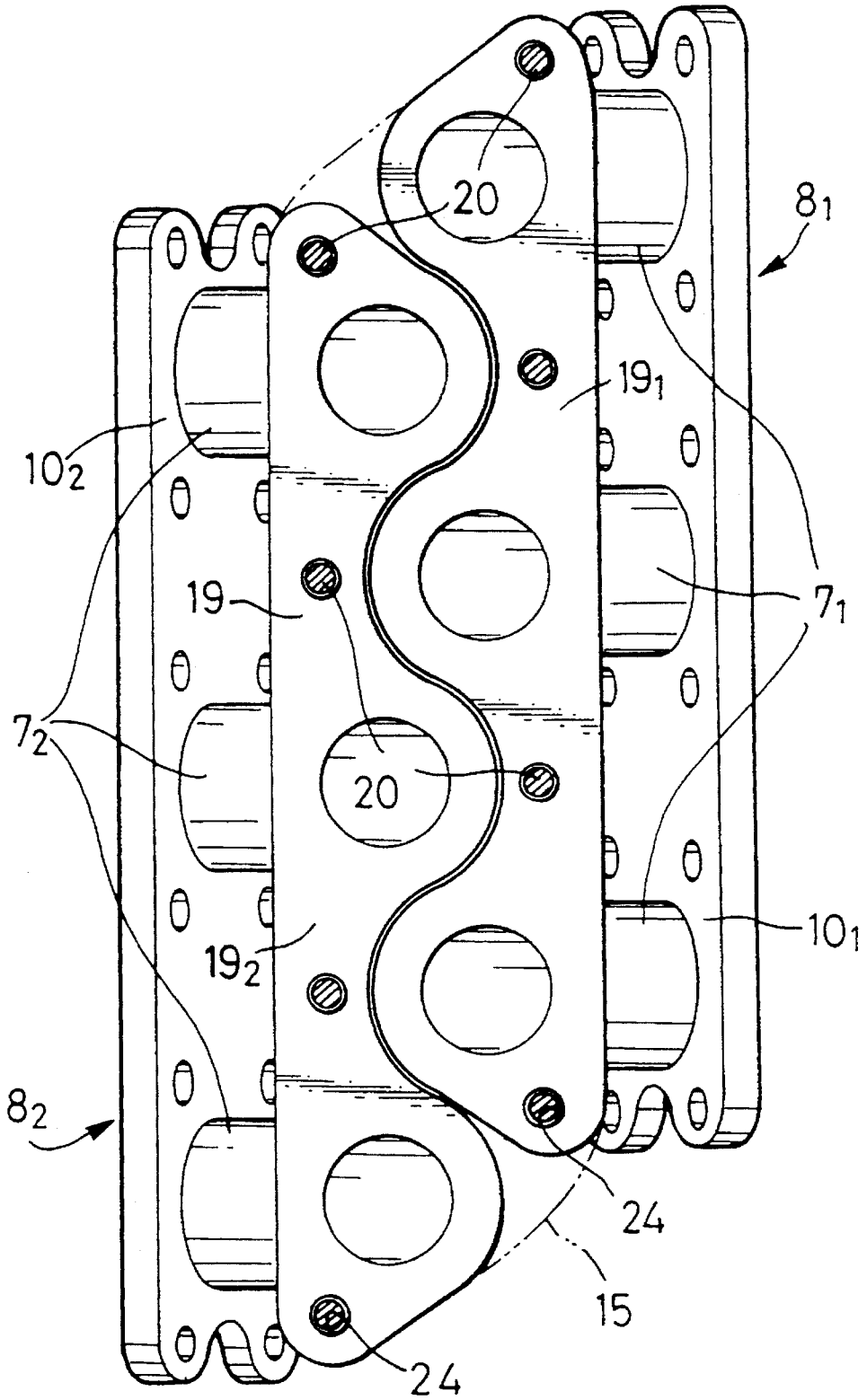
FIG. 2 is an enlarged sectional view taken along a line 2—2 in FIG. 1.
Figure 3:
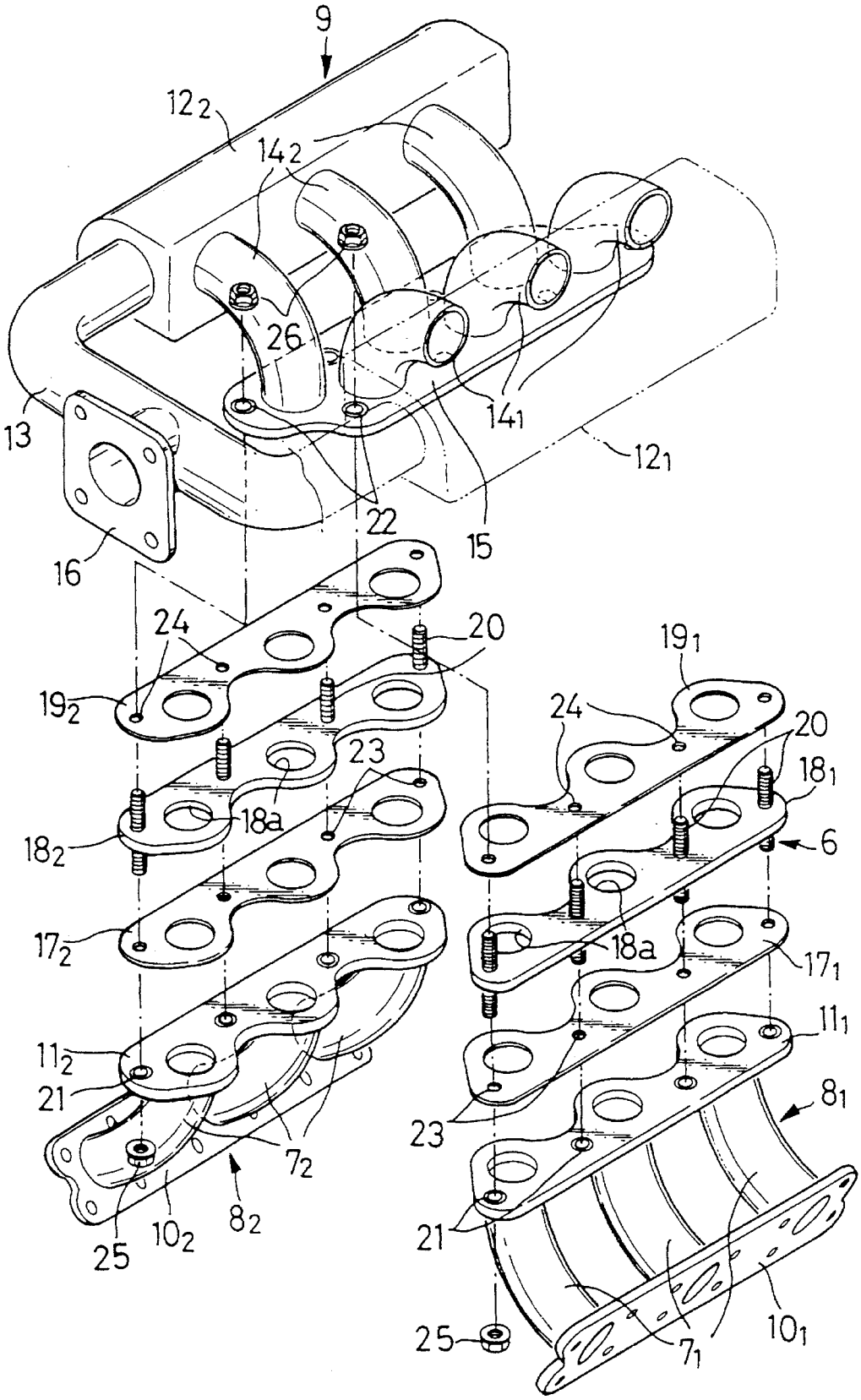
FIG. 3 is an exploded perspective view of the intake manifold.
Figure 4:
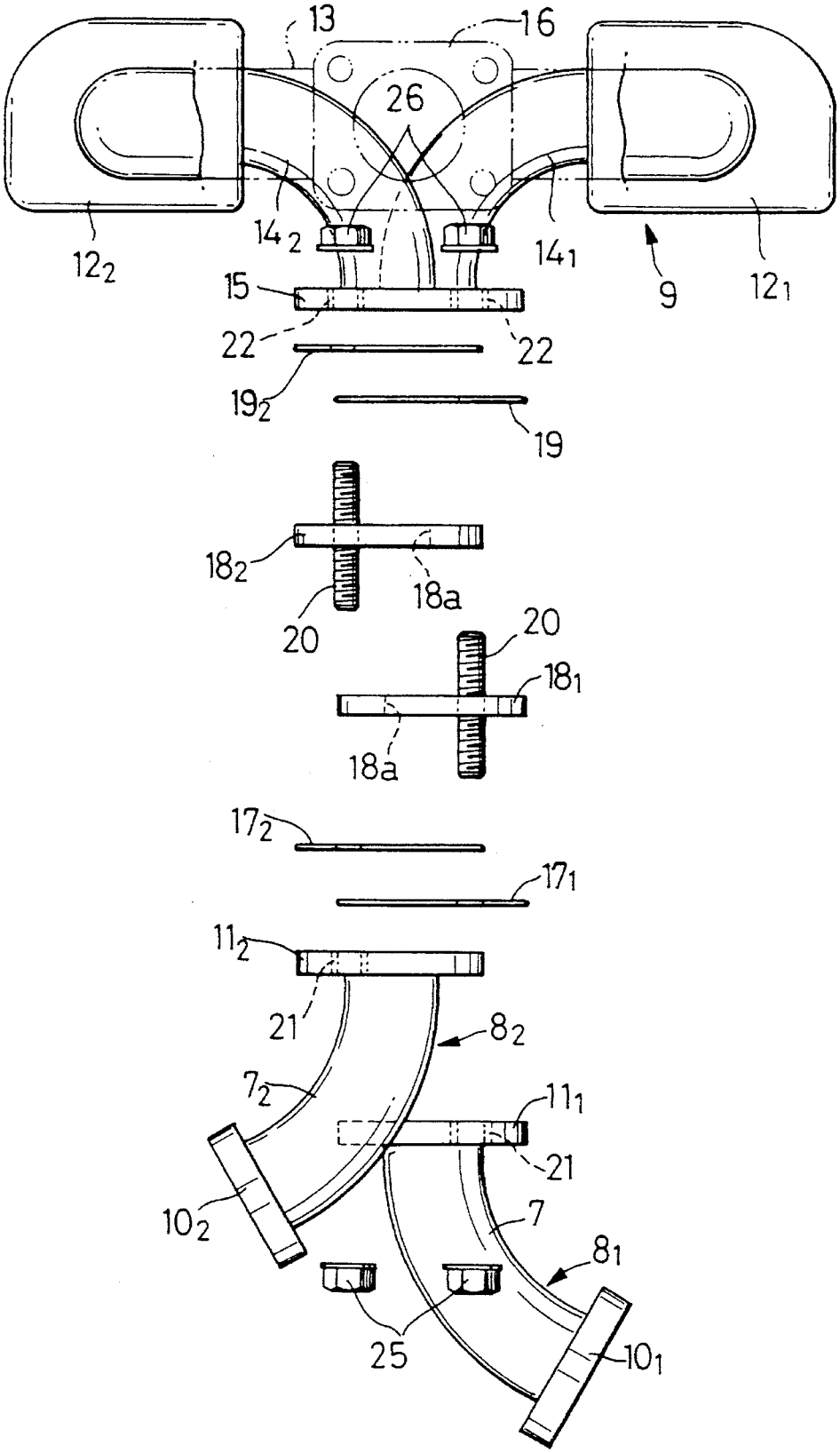
FIG. 4 is an exploded side view of the intake manifold.

Referring also to FIGS. 2, 3 and 4, the intake manifold 6 includes a first intake pipe assembly $\mathbf{8}_1$ which has three intake pipes $\mathbf{7}_1$ that communicate at their one ends with the intake ports $5_1$ in the first cylinder head $2_1$, respectively, and which is flange-coupled at one end to the first cylinder head $2_1$. A second intake pipe assembly $8_2$ which has three intake pipes $7_2$ that communicate at their one ends with the intake ports $5_2$ in the second cylinder head $2_2$, respectively, and which is flange-coupled at one end to the second cylinder head $2_2$. A surge tank 9 is flange-coupled commonly to the other ends of the first and second intake pipe assemblies $8_1$ and $8_2$.

The first intake pipe assembly $8_1$ is formed from a synthetic resin and includes the three intake pipes $7_1$ corresponding to the intake ports $5_1$ in the first cylinder head $2_1$, a flange $10_1$ provided commonly at one end of the intake ports $7_1$, and a flange $11_1$ provided commonly at the other end of the intake ports $7_1$. The flange $10_1$ at the one end is coupled to that side of the first cylinder head $2_1$ which faces the valley 4.

The second intake pipe assembly $8_2$ is formed from a synthetic resin so as to have the same shape as the first intake pipe assembly $8_1$, and has a flange $10_2$ which is provided commonly at one end of the three intake ports $7_2$ independently corresponding to the intake ports $5_2$ in the second cylinder head $2_2$. The flange $10_2$ is coupled to that side of the second cylinder head 22 which faces the valley 4.

Thus, the first and second intake pipe assemblies $8_1$ and $8_2$ are disposed symmetrically with respect to a plane L (see FIG. 1) passing through the center of the bank angle $\alpha$ formed by both the cylinder heads $2_1$ and $2_1$.

The surge tank 9 includes a pipe-meeting portion $12_1$ which is disposed adjacent the first cylinder head $2_1$ so as to extend in a direction of arrangement of the cylinders in the cylinder block 1. A pipe-meeting portion $12_2$ is disposed adjacent the second cylinder head $2_2$ so as to extend in a direction parallel to the pipe-meeting portion $12_1$. The pipe-meeting portion $12_1$ and $12_2$ are closed at a first end thereof and a connecting pipe portion 13, which is formed into a substantially U-shape, connects a second end of the pipe-meeting portions $12_1$ and $12_2$. The surge tank 9 further includes three conduit portions $14_1$ which are connected at a first end to an inner surface of one of the pipe-meeting portions $12_1$ in correspondence to the intake pipes $7_1$ of the first intake pipe assembly $8_1$. The surge tank further includes three conduit potion $14_2$ which are connected at a first end to an inner surface of the pipe-meeting portion $12_2$ in correspondence to the intake pipes $7_2$ of the second intake pipe assembly $8_2$. The surge tank 9 further includes, a flange 15 to which a second end of the conduit portions $14_1$ and $14_2$ are commonly connected, and a flange 16 provided at an intermediate portion of the connecting pipe portion 13. The flange 16 is connected to a throttle body which is not shown.

The flange 15 of the surge tank 9 is formed into a flat plate-like shape which is perpendicular to the plane L, passing the center of the bank angle $\alpha$, and which substantially corresponds to the shape of the mated flanges $11_1$, $11_2$ of the first and second intake pipe assemblies $8_1$ and $8_2$.

The flanges $11_1$, $11_2$ of the first and second intake pipe assemblies $8_1$ and $8_2$ are commonly coupled to the flange 15 of the surge tank 9. A gasket $17_1$, spacer $18_1$ and a gasket $19_1$ are interposed, in the above named order beginning from flange $11_1$, between the flange $11_1$ and the flange 15 of the surge tank 9. A gasket $17_2$, a spacer $18_2$ and a gasket $19_2$ are likewise interposed between the flange $11_2$ and the flange 15 of the surge tank 9. The gaskets 17 and 19 are formed into the substantially same shape as the flanges 11.

The spacers 18 are formed of substantially the same shape as the flanges 11 and from a metal having a higher rigidity and a lower thermal elongation that those of the synthetic resin forming the intake pipe assemblies $8_1$ and $8_2$ and the surge tank 9, such as an aluminum alloy, a stainless steel or the like. A plurality of, for example, four, clamping bolts 20 are integrally provides on the spacers 18. An intermediate portion of each of the clamping bolts 20 projects from opposite sides of the spacers 18. Passages 18*a* are provided in the spacers 18 to lead to the intake pipes 7 of the intake pipe assembly 8, respectively.

On the other hand, cylindrical collars 21 and 22 are made of a rigid metal material and are integrally provided respectively in those portions of the flanges 11 and 15 which correspond to the clamping bolts 20 in such a manner that they are embedded in the flanges 11 and 15, when the flanges 11 and 15 are molded. The gaskets 17 and 19 at opposite ends of the spacer 18 are provided with insertion holes 23 and 24 through which the opposite ends of the cylindrical clamping bolts 20 are inserted, respectively.

One end of each of the clamping bolts 20 is inserted through a corresponding insertion hole 23 in the gasket 17 and a corresponding collar 21, and a nut 25 is threadedly fitted over one end of each clamping bolt 20 projecting from the flange 11. The other end of each of the clamping bolt 20 is inserted through a corresponding insertion hole 24 in the gasket 19 and a corresponding collar 22, and a nut 26 is threadedly fitted over the other end of each clamping bolt 20 projecting from the flange 15. By tightening the nuts 25 and 26, the flanges 11 and 15 are clamped with the spacer 18 and the gaskets 17 and 19 on the opposite sides of the spacer 18 being interposed between the flanges 11 and 15.

The operation of the first embodiment will be described below. It is possible to provide a reduction in weight of the intake manifold 6 and in turn to provide a reduction in weight of the engine by the formation of the intake pipe assemblies $8_1$ and $8_2$ and the surge tank 9 constituting an essential portion of the intake manifold 9 from a synthetic resin.

Moreover, the flanges $11_1$, $11_2$ of the intake pipe assemblies $8_1$ and $8_2$ made of the synthetic resin and the flange 15 of the surge tank 9 made of the synthetic resin are clamped to each other by the clamping bolts 20 in a condition in which the spacers $18_1$ and $18_2$, made of the metal having a higher rigidity and a lower thermal engine than those of the synthetic resin forming the intake pipe assemblies $8_1$ and $8_2$ and the surge tank 9, are interposed between the flanges $11_1$, $11_2$ and the flange 15. In other words, a construction is obtained in which the flanges $11_1$ $11_2$ of the spacers $18_2$ and $18_2$ and the flange 15 of the surge tank 9 are clamped to the spacers 18 interposed between these flanges $11_1$, $11_2$ and the flange 15 respectively. In this case, the rigidity of clamped portions between the flanges $11_1$, $11_2$ and the flange 15 is enhanced. Therefore, when the flanges $11_1$ $11_2$ and the flange 15 are clamped directly to each other, a concentration of stress is applied to the clamped portions between the flanges $11_1$, $11_2$ and the flange 15 with the displacement of the intake pipe assemblies $8_1$ and $8_2$ caused by the thermal elongation and vibration of the cylinder heads $2_1$ and $2_2$. On the contrast, even with the created rigidity of the clamped portions enhanced in the above manner, such a concentration of stress can be moderated. Moreover, even if a gap is produced between the flanges $11_1$, $11_2$ and the flange 15 because influences of warp and a thermal elongation of the intake pipe assemblies $8_1$ and $8_2$ and the surge tank 9, at the start of and during operation of the engine, the gap can be suppressed to a small level by the interposition of the spacers $18_1$ between the flanges $11_1$, $11_2$ and the flange 15. This contributes to an enhancement in sealability.

Figure 5:
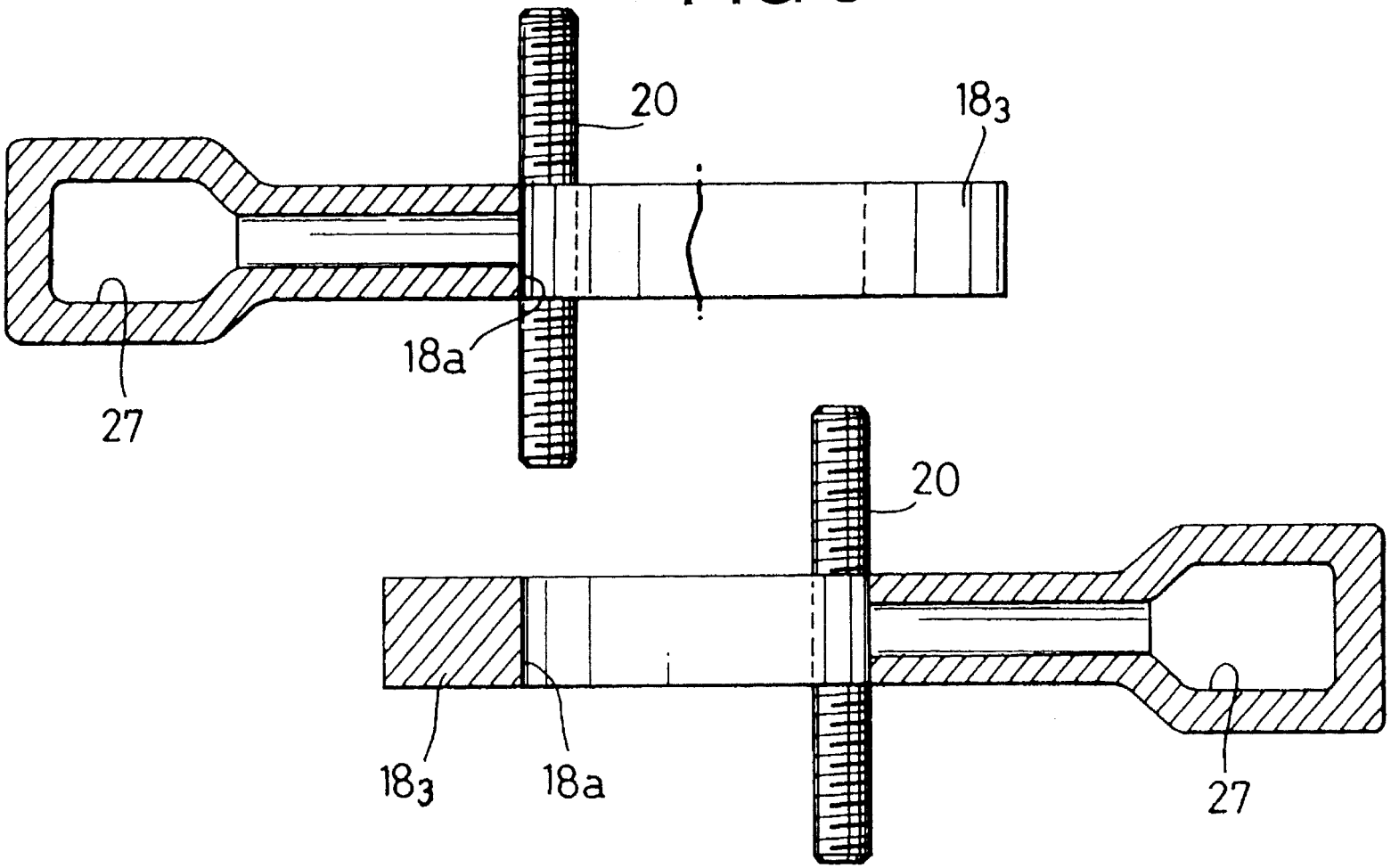
FIG. 5 is a longitudinal sectional side view of a spacer according to a second embodiment.

FIG. 5 illustrates a second embodiment of the present invention, in which additive intake gas passages 27 for guiding an EGR gas, a blow-by gas or a secondary gas are defined in the spacers $\mathbf{18}_3$, so as to lead to the passages 18*a*.

With such construction, it is unnecessary to separately provide a pipe line for introducing an EGR gas, a blow-by gas or secondary air, thereby enabling reductions in the number of parts and in the number of assembling steps.

Figure 6:
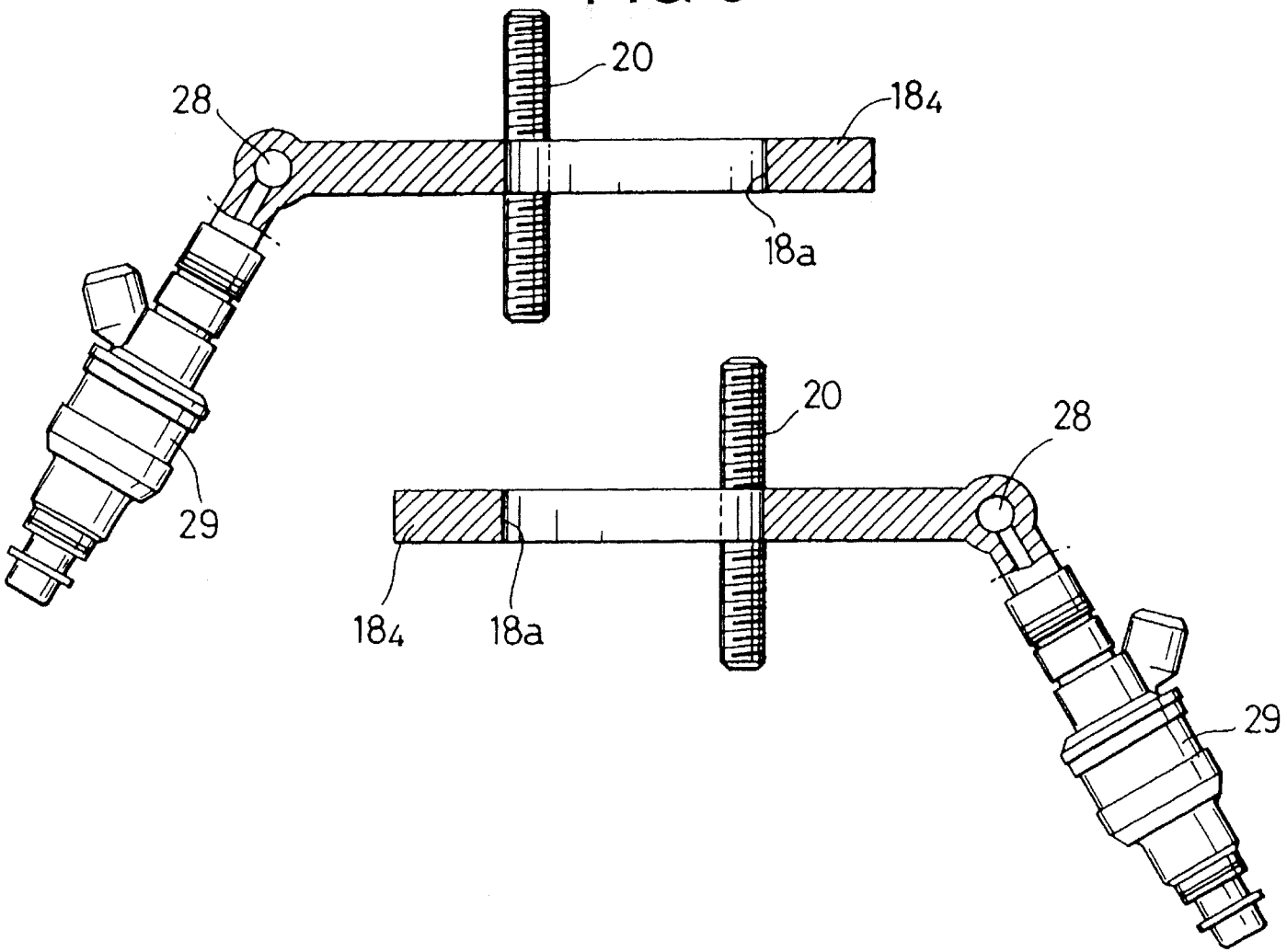
FIG. 6 is a longitudinal sectional side view of a spacer according to a third embodiment.

FIG. 6 illustrates a third embodiment of the present invention, in which fuel passages 28 are defined in spacer $\mathbf{18}_4$ and connected to fuel injection valves 29. The fuel injection valves 29 may be supported on the spacers $\mathbf{18}_4$.

Even in the third embodiment, it is unnecessary to separately provide a pipe line for introducing fuel into the fuel injection valves 29, thereby enabling reductions in the number of parts and in the number of assembling steps.

Figure 7:
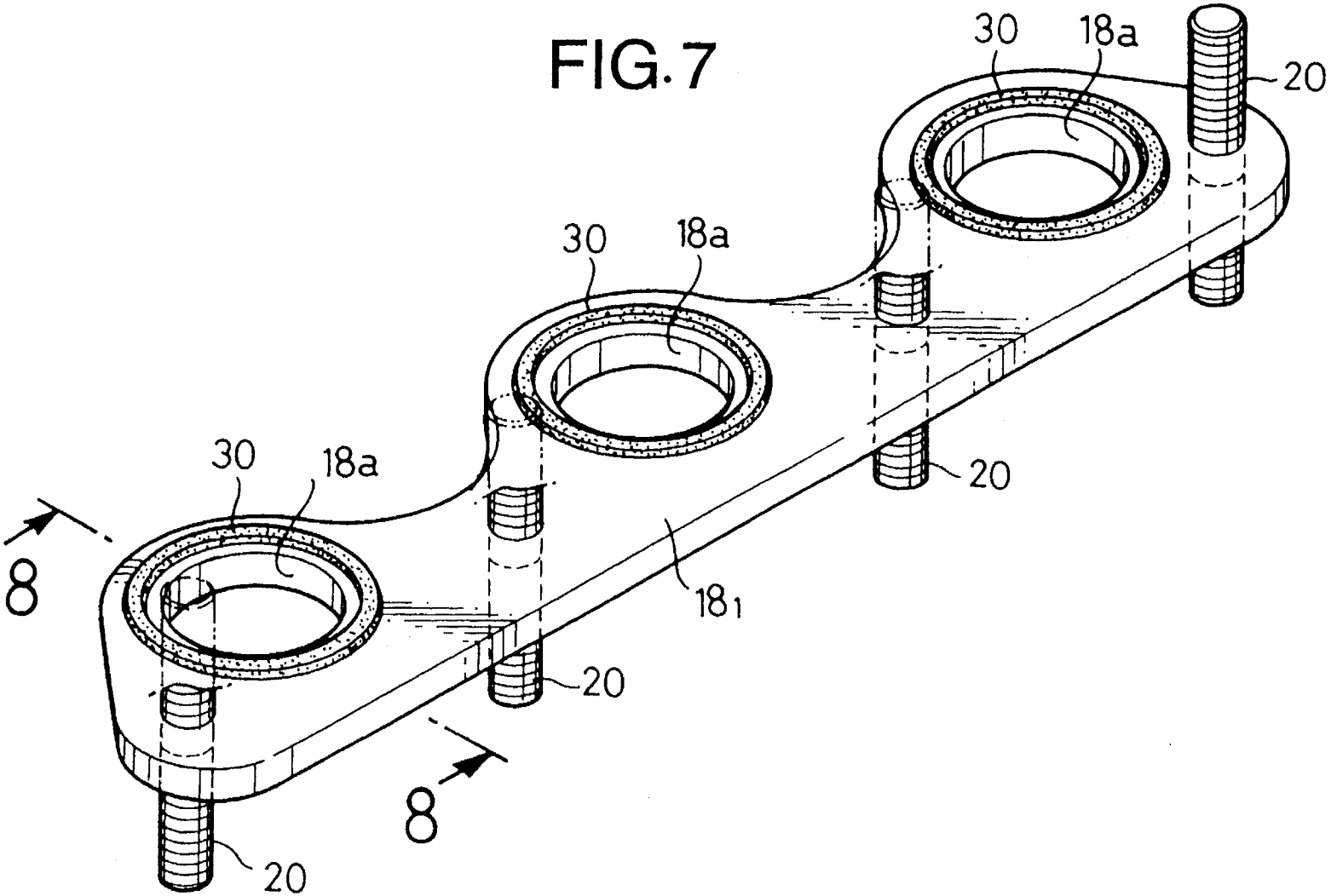
FIG. 7 is a perspective view of a spacer according to a fourth embodiment.
Figure 8:
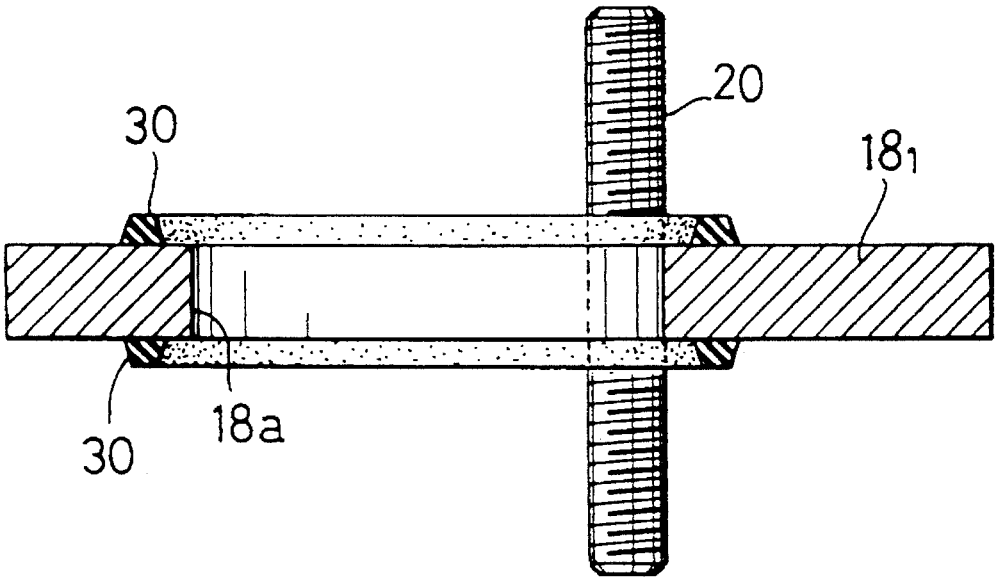
FIG. 8 is a sectional view taken along a line 8—8 in FIG. 7.

FIGS. 7 and 8 illustrate a fourth embodiment of the present invention, in which O-rings 30 are used as gaskets for sealing each of the intake pipe assemblies $\mathbf{8}_1$ and $\mathbf{8}_2$ and each of the flanges $\mathbf{11}_1$, $\mathbf{11}_2$ and 15 of the surge tank 9 from each other. The O-rings are provided on opposite surfaces of a spacer $\mathbf{18}_1$, for example, by baking or the like, so as to coaxially surround each of passages 18*a*.

In the fourth embodiment, it is also unnecessary to prepare a gasket separately from the spacer $\mathbf{18}_1$, thereby enabling reductions in the number of parts and in the number of assembling steps.

Although the embodiments of the present invention have been described in detail, it will be understood that the present invention is not limited to the above-described embodiments, and various modifications may be made without departing from the spirit and scope of the invention defined in claims.

For example, the pair of spacers $\mathbf{18}_1$, $\mathbf{18}_2$; $\mathbf{18}_1$, $\mathbf{18}_2$; $\mathbf{18}_3$, $\mathbf{18}_3$; and $\mathbf{18}_4$, $\mathbf{18}_4$ may be integrally coupled to each other. In other words, a single spacer may be interposed between each of the flanges $\mathbf{11}_1$, $\mathbf{11}_2$ of the intake pipe assemblies $\mathbf{8}_1$ and $\mathbf{8}_2$ and the flange 15 of the surge tank 9.

Accordingly, reference should be made to the following claims in determining the full scope of the invention.

What is claimed is:

1. An intake system for use in a V-shaped engine, comprising:

an intake manifold capable of being disposed in a valley defined between a pair of cylinder heads disposed in a substantially V-shaped arrangement, wherein said intake manifold includes first and second intake pipe assemblies each having a plurality of intake pipes capable of being coupled at a first end of said respective intake pipes to said cylinders heads, respectively and wherein a second end of said first intake pipe assembly is provided with a first flange and a second end of said second intake pipe assembly is provided with a second flange;

a surge tank;

wherein said first and second said intake pipe assemblies and said surge tank are formed from a synthetic resin; and a spacer made of metal and having clamping bolts integrally provided thereon;

wherein said spacer is interposed between said flanges provided at said second end of said first and second intake pipe assemblies and a third flange that is provided at said surge tank;

wherein said first, second and third flanges are coupled by said clamping bolts inserted through said first and second flanges so as to flange-couple said surge tank and first and second intake pipe assemblies.

2. An intake system for use in a V-shaped engine as claimed in claim 1, further comprising an additional intake gas passage defined in said spacer.

3. An intake system for use in a V-shaped engine as claimed in claim 1, further comprising a fuel passage defined in said spacer and connected to a fuel injection valve.

4. An intake system for use in a V-shaped engine as claimed in claim 1, wherein said spacer is integrally provided at opposite surfaces with a gasket for sealing between said first and second flanges of said intake pipe assemblies and said third flange of said surge tank.

* * * * *